United States Patent [19]

Anhalt et al.

[11] 3,992,072

[45] Nov. 16, 1976

[54] ELECTRICAL CONNECTOR

[75] Inventors: John W. Anhalt, Orange; James H. Curley, Costa Mesa, both of Calif.

[73] Assignee: International Telephone and Telegraph Corporation, New York, N.Y.

[22] Filed: Feb. 23, 1976

[21] Appl. No.: 660,690

[52] U.S. Cl. ..... 339/97 P

[51] Int. Cl.[2] ..... H01R 13/38

[58] Field of Search ..... 339/97–99, 339/206, 207, 209, 210, 274

[56] References Cited

UNITED STATES PATENTS

| | | | |
|---|---|---|---|
| 3,860,318 | 1/1975 | Reavis, Jr. et al. | 339/99 R |
| 3,950,063 | 4/1976 | Johansson | 339/97 R |
| 3,955,873 | 5/1976 | Peterson | 339/99 R |

*Primary Examiner*—Joseph H. McGlynn

*Attorney, Agent, or Firm*—Thomas L. Peterson

[57] ABSTRACT

A printed circuit board connector is disclosed which contains insulation displacing contacts. A plurality of individual conductor inserting caps are mounted on the connector housing by integral thin hinge sections so that conductors may be independently connected to the contacts by the caps. A positive latch arrangement is provided which secures the caps in position on the connector housing after the conductors have been connected to the contacts. Thus, conductors can be removed or replaced individually in the connector.

11 Claims, 5 Drawing Figures

ELECTRICAL CONNECTOR

BACKGROUND OF THE INVENTION

This inventin relates generally to an electrical connector and, more particulary, to an electrical connector containing insulation displacing electrical contacts.

It is common practice to electrically and mechanically connect a conductor to an electrical contact by providing a narrow slot in the contact and moving the conductor laterally of its axis into the slot so that the edges of the slot displace or pierce the insulation and penetrate the core of the conductor to establish electrical contact therewith. A connector containing insulation displacing contacts of this type is disclosed, for example, in U.S. Pat. No. 3,860,318 to Reavis, Jr. et al. Such connector is a printed circuit board connector in which each contact therein has a tubular termination section formed with a longitudinally extending slot which receives the conductor to be terminated to the contact. The conductors are simultaneously attached to the contacts by the use of a suitable fixture disclosed in a patent. The requirements of a special fixture to perform the termination procedure has obvious disadvantages. The use of a special fixture adds to the cost of making the terminations and, in some occasions, the fixture may not be available at an installation where, for example, old terminations must be replaced.

In copending application of Carl W. Peterson entitled, "Electrical Connector and Contacts Therefor", Ser. No. 527,600, filed Nov. 27, 1974, there is a disclosed an electrical connector having insulation displacing contacts in a connector housing. A cover for the housing functions as a tool which forcibly inserts the conductors into the temination sections of the contacts when the cover is attached to the housing. While this arrangement overcomes the requirement for a special fixture to perform the conductor termination procedure, all the contacts are terminated simultaneously as in the Reavis, Jr. et al. patent. The simultaneous insertion of the conductors into the contacts in the connector is certainly advantageous in making an initial electrical installation due to the savings in time which results. However, such an arrangement has the disadvantage that the cover for the connector housing must be completely removed in order to permit removal or replacement of conductors in the connector, such as may be required when modifying the connection system in the future or to make repairs. The cover of the connector may be dropped or misplaced by the serviceman. Furthermore, removal of the cover may result in inadvertent removal of some of the conductors from the connector with a possible poor electrical and mechanical connection being achieved when such conductors are again terminated to the contacts. Furthermore, if manufacturing tolerances are not carefully maintained, it is possible that complete termination of the conductors to the contacts may not be achieved when all the conductors are terminated simultaneously, as when using the connector cover as the conductor insertion tool.

It is the purpose of the present invention to overcome the aforementioned disadvantages of the prior art connectors by providing an insulation displacement connector which does not require fixture for terminating the conductors to the contacts therein nor removal of a connector cover, and which allows independent termination of conductors to the contacts so that individual conductors may be removed or replaced with a minimum of time and with no risk of adversely affecting the terminations of other conductors to the contacts in the connector.

SUMMARY OF THE INVENTION

According to the principal aspect of the present invention, there is provided an electrical connector comprising an elongated insulative housing having a conductor receiving side and a mating side. A row of spaced contact receiving cavities are formed in the housing, each of which contains a contact having a contacting section on the mating side of the housing and a termination section on the conductor receiving side of the housing. The termination section of each contact embodies insulation displacing, conductor core penetrating jaws. A row of individual conductor terminating caps are provided on the conductor receiving side of the housing. Each cap is aligned with the termination section of one of the contacts. A relatively thin hinge section pivotally connects each of the caps to the housing so that each cap is movable from a first position overlying the end of the termination section of its respective contacts to a second position out of alignment with the termination section. Each cap embodies means for forcibly inserting a conductor into the jaws of its corresponding contact to electrically connect the conductor to the contact when the cap is pivoted from the second position out of alignment with the contact to the first position mentioned above. Since the caps are pivotally mounted to the connector housing, they need not be removed in order to permit insertion or removal of a conductor from a contact in the housing. Furthermore, any individual cap may be pivoted to the second position out of alignment with the termination section of its corresponding contact to permit removal or replacement of a conductor in the connector. Thus, by the present invention, there are provided integral, individual terminating caps on a connector housing which permits easy servicing of the connector in the field without the necessity of a special fixture to terminate the conductors to the contacts nor the disassembly of the entire connector. These and other objects of the invention will become more apparent from the following description taken in connection with the accompanying drawings.

DESCRIPTION OF THE PREFERRED EMBODIMENTS

Figure 1:
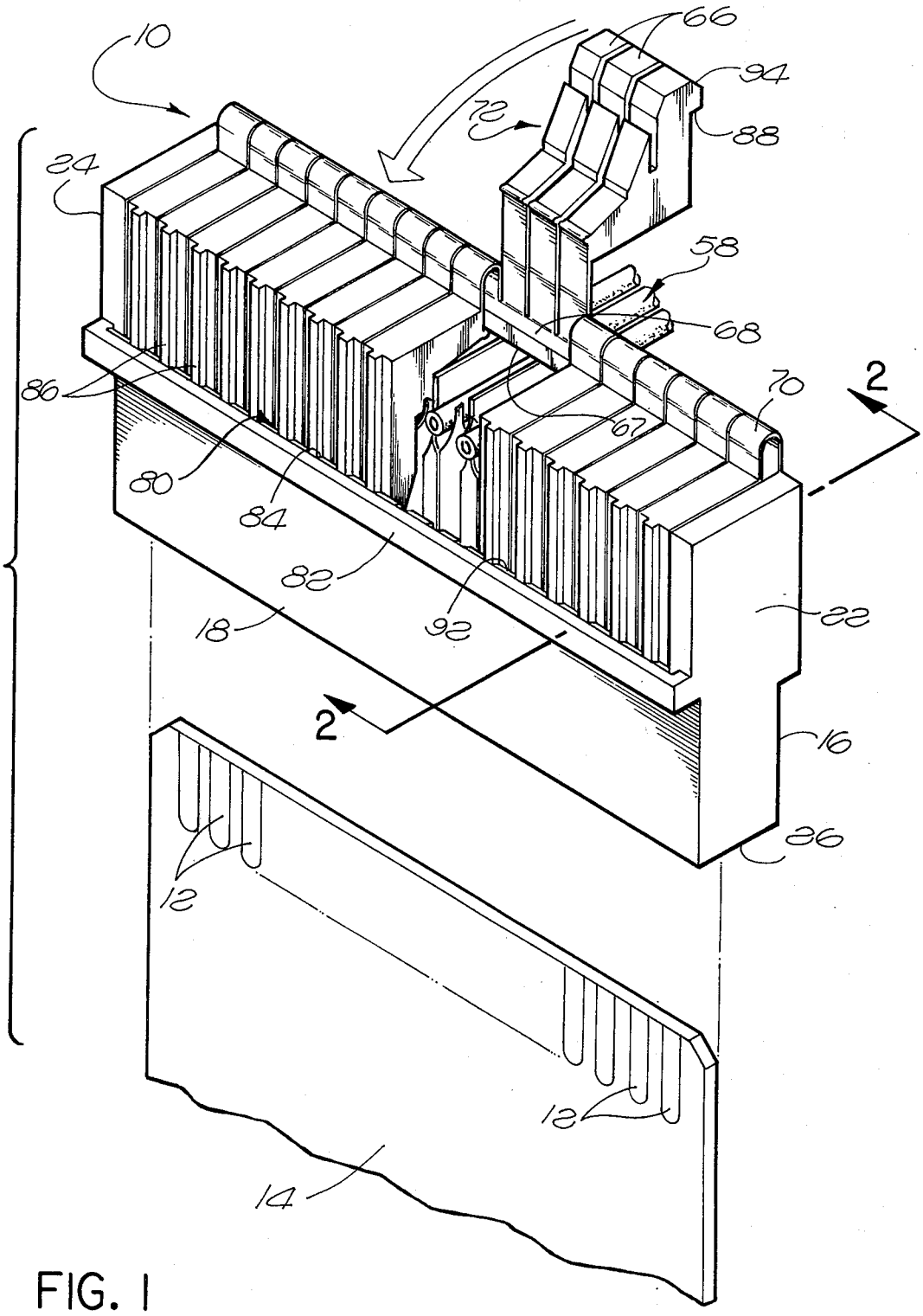
FIG. 1 is a perspective view of the connector of the present invention positioned to receive a printed circuit board and having three conductor terminating caps thereon pivoted to their open position prior to inserting conductors into the contacts associated with such caps.

Referring now to the drawings in detail, there is illustrated in FIG. 1 the connector of the present invention, generally designated 10. In its preferred form, the connector is a printed circuit board connector for making electrical connections to the traces 12 on a printed circuit board 14 shown below the connector.

The connector comprises an elongated, upstanding, insulative housing 16 having a pair of vertical sidewalls 18 and 20 and opposed end walls 22 and 24. The housing has a mating side 26 and a conductor receiving side 28. A row of cavities 30 are formed in the housing extending from the mating side to the conductor receiving side thereof. The cavities are separated by laterally extending walls 31. A contact 32 is mounted in each of the cavities.

Figure 2:
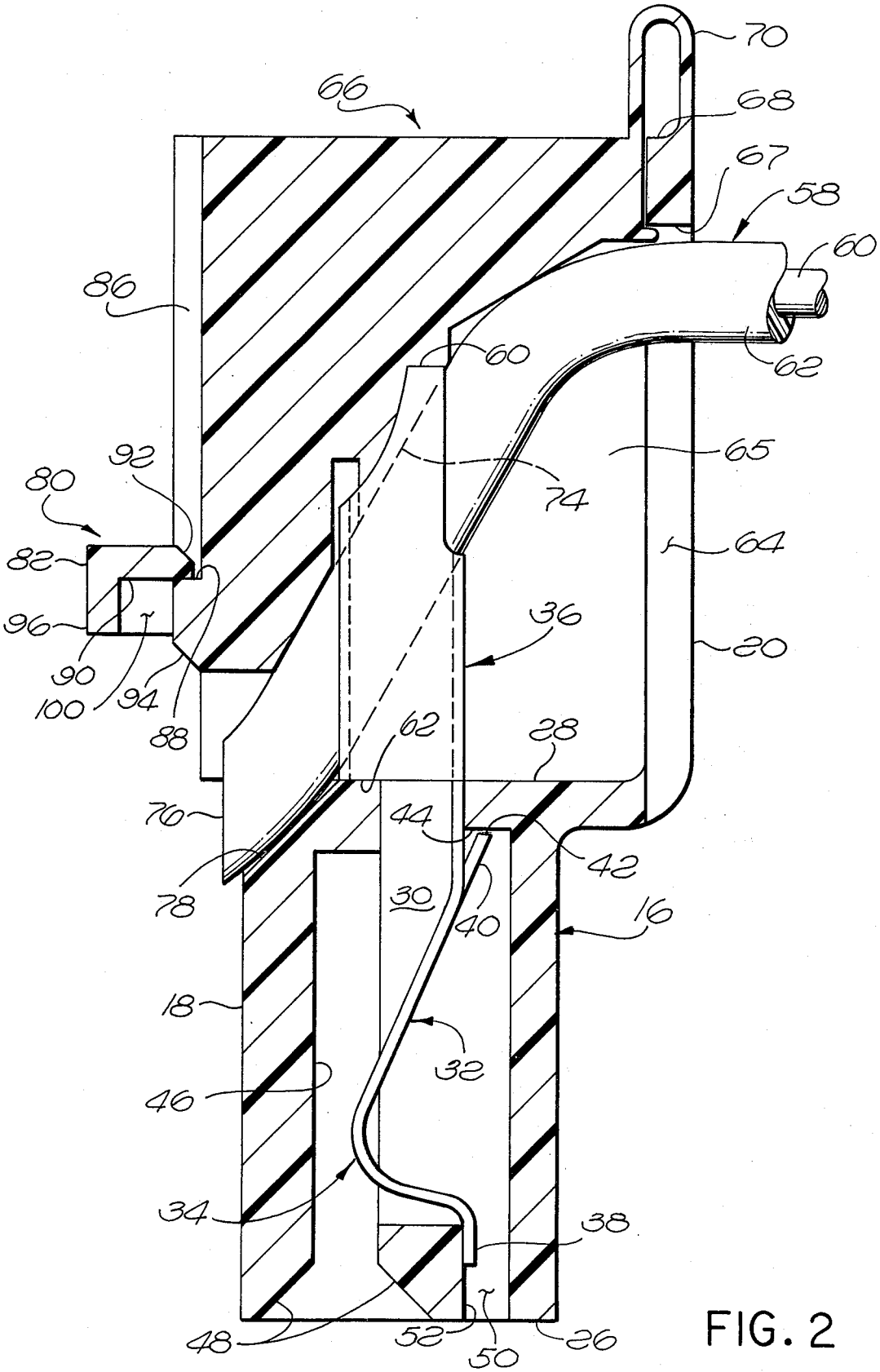
FIG. 2 is transverse sectional view taken along line 2—2 of FIG. 1 showing one of the caps in its closed position fully terminating a condutor to a contact in the connector.
Figure 3:
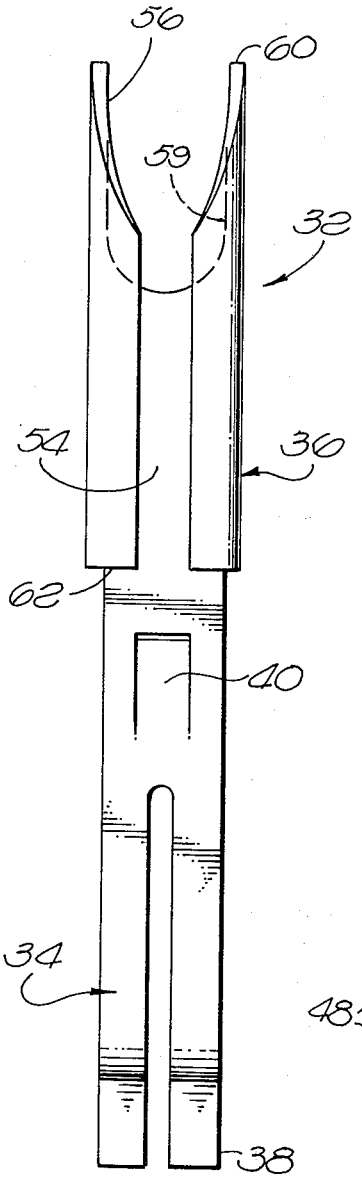
FIG. 3 is a front view of one of the contacts employed in the connector illustrated in FIG. 1.
Figure 4:
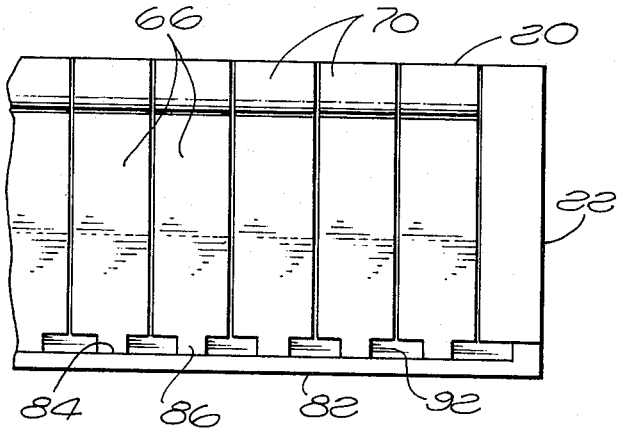
FIG. 4 is a fragmentary, top view of the connector illustrated in FIG. 1.
Figure 5:
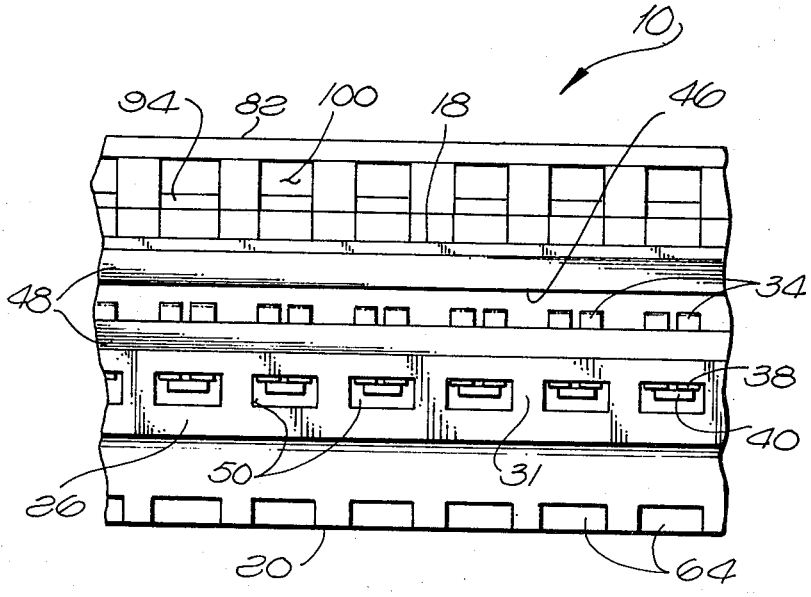
FIG. 5 is a fragmentary, bottom view of the connector illustrated in FIG. 1.

As best seen in FIGS. 2 and 3, each contact 32 has a bowed, bifurcated spring contacting section 34 on the mating side of the connector and a tubular termination section 36 on the conductor receiving side. The contact is formed with a downwardly extending vertical flange 38 at the lower end of the spring contacting section 34. A resilient retention tine 40 is stamped out of an intermediate section of the contact above the contacting section 34. The tine extends upwardly and outwardly. The end 42 of the tine is positioned adjacent to a downwardly facing surface 44 in the contact cavity to limit upward movement of the contact in the cavity.

The housing is formed with an elongated slot 46 extending between the end walls 22 and 24. The slot opens at the mating or lower side of the housing. The sides of the slot are chamfered as indicated at 48. The bowed contacting sections 34 of the contacts extend into the slot for engaging the conductive traces 12 on the printed circuit board 14 when the latter is inserted into the slot. A row of openings 50 are formed in the lower end of the housing 16. The openings are aligned with the contact cavities 30 and extend from the mating side 26 of the connector housing into the cavities. The flanges 38 on the contacts engage the inner surfaces 52 of the openings for preloading the contacts in a manner well known in the printed circuit board connector art. The openings 50 also allow the insertion of a suitable tool, not shown, upwardly into the contact cavity to deflect the retention tine 40 inwardly away from the surface 44, thereby allowing the contact to be removed vertically upwardly out of the connector housing.

The upper termination section 36 of the contact has a tubular configuration. A slot 54 extends longitudinally through the entire length of the tubular section. The slot is enlarged at its upper end to provide an entryway 56 for a conductor to be terminated to the contact. Such a conductor is illustrated in FIGS. 1 and 2 and generally designated 58. The conductor comprises a metallic core 60 covered with an insulation layer 62. The width of the slot 54 is less than the diameter of the core 60 of the conductor. The edges of the slot 54 define insulation displacing, core penetrating jaws. A second slot 59 is formed in the tubular termination section of the contact on the side thereof opposite to the slot 54. The slot 59 opens only at the upper or outer end 60 of the contact. The width of the slot 59 is greater than the diameter of the core of conductor 58, but less than the diameter of the insulation layer 62 on the core. The edges of the slot 59 form insulation penetrating strain relief jaws. To terminate a conductor 58 to a contact 36, the conductor is forced laterally downwardly through the slots 54 and 59, preferably at an acute angle as illustrated in FIG. 2. The jaws formed by the slot 54 will become electrically and mechanically connected to the core 60 of conductor 58, and the jaws formed by the slot 59 will engage only the insulation layer 62 to provide strain relief for the electrical connector. For a more detailed description of the termination section 36 of the contact, reference may be made to the aforementioned copending Peterson application.

It is noted that the lower end 62 of the tubular termination section of the contact engages the conductor receiving side 28 of the connector housing when the contact is fully seated in a contact cavity 30. Thus, the lower end 62 of the termination section limits downward movement of the contact in the housing while the retention tine 40 limits upward movement of the contact so that the contact is releasably retained in the connector housing.

As seen in FIG. 2, the sidewall 20 of the connector housing extends upwardly beyond the sidewall 18. A plurality of elongated vertical slots 64 are formed in the sidewall 20 aligned with the contact cavities 30 and, thus, the termination sections 36 of the contacts mounted in the cavities. The width of each slot 64 is slightly greater than the diameter of the conductor 58 so that a conductor may be freely inserted through the slot into the upper region of the connector housing. A plurality of conductor terminating caps 66 are pivotally mounted to the outer or upper edge 68 of the sidewall 20 by thin, flexible hinge sections 70 integral with the caps and the housing wall. Such hinge sections are normally referred to in the art as being "live" hinges. The caps 66 are equal in number to the contacts 32 and each cap is positioned in alignment with the termination section 36 of a corresponding contact. Relatively thin laterally extending walls 65 extend from the sidewall 20 a short distance beyond the sidewall 18 between the caps 66 to electrically isolate the termination sections of the contacts from each other in the housing.

It is noted that each contact 32 is oriented in its cavity 30 so that the wider slot 59 of the termination section of the contact faces the sidewall 20 of the connector housing. The length of the termination section 36 of the contact is selected so that the distance between the upper end 60 of the termination section and the upper end 67 of the slot 64 in the housing wall is greater than the diameter of the conductor 58 so that a conductor may be freely inserted through the slot 64 into a position over the termination section of the contact.

Each cap 66 is independently movable with respect to the other caps, and is pivoted from an open position as illustrated by the three raised caps in FIG. 1, to a closed position as best seen in FIG. 2. When the cap is in its open position, a conductor 58 may be inserted through a slot 64 in the sidewall 20 from the right side of the connector housing, as viewed in FIG. 2, and positioned in alignment over the slots 54 and 56 in the termination section 36 of a contact. Each cap 66 has an inclined surface, generally designated 72, which extends downwardly from adjacent to the upper edge 67 of the slot 64 toward the sidewall 18 on the opposite side of the connector housing when the cap is in its closed position, as seen in FIG. 2. A projection 74 is formed on the inclined surface 72 of the cap by a longitudinally extending vertical slot 75 and a recess 76 in the surface. The projection 74 is dimensioned and located so as to extend into the upper end of the tubular termination section 36 of the contact 32 when the cap 66 is in its closed position.

To terminate a conductor 58 to a contact 32, the conductor is inserted through the slot 64 in the sidewall of the housing over the termination section of the contact, as illustrated in FIG. 1, so that the conductor is aligned with the slots 54 and 59 in the termination section of the contact. The conductor is allowed to drop into the entryway 56 of the termination section of the contact. Then the terminating cap 66 for the contact is shifted from the open position illustrated in FIG. 1 to the closed position illustrated in FIG. 2 whereupon the projection 74 and the regions of the inclined surface 72 of the cap on the opposite sides of the projection will push the conductor downwardly into the slots 54 and 59 to make an electrical and mechanical connection thereto in the maner previously described herein. It is noted that by the configuration of the cap 66, the conductor 58 is inserted at an acute angle into the termination section of the contact. The terminal end 76 of the conductor extends into an inclined recess 78 on the sidewall 18 as seen in FIG. 2. It will be further noted that when the conductor terminating caps are in their closed position, they substantially enclose the termination sections 36 of the contacts in the connector housing.

Latching means, generally designated 80, is provided for releasably retaining the conductor terminating caps 66 in their closed position. Such latching means comprises an elongated resilient strip 82 which is adjacent to the sidewall 18 and integrally joined at its opposite ends to the end walls 22 and 24 of the connector housing above the conductor receiving side 28. The inner surface of strip 82 is formed with vertically extending keyways 84 aligned with the caps 66. Each cap is formed with a vertically extending key 86 which engages in a keyway 84. An upwardly facing shoulder 88 is formed on each cap at the lower end of its respective key 86. The shoulder 88 engages the lower surface 90 of the strip 82 when the cap is in its closed position. The upper inner edge of the strip 82 is bevelled, as indicated at 92. Likewise, a bevel 94 is formed on the lower outer edge of the cap 66. The strip 82 is sufficiently resilient so that when the cap 66 is moved from its upper open position to its lower closed position, the strip will shift laterally outwardly by the camming engagement of the bevelled surface 94 on the cap with bevelled edge 92 on the strip. When the shoulder 88 passes the lower surface 90 of the strip upon closing of the cap 66, the strip 82 will snap back into position as illustrated in FIG. 2, whereby the cooperating surfaces 88 and 90 on the cap and strip, respectively, provide a positive latch for the cap.

The strip 82 is formed with a downwardly extending lip 96 adjacent to its outer edge. The lip is spaced from the outer lower surfaces of the caps 66, thereby defining a gap 100 between the caps and the lip. To release the latching means 80 to allow the opening of any individual conductor terminating cap 66, a screwdriver or like tool is inserted into the gap 100 between the lip 96 adjacent to the selected cap and twisted to deflect the strip 82 outwardly allowing the cap to be raised to its open position.

It will be appreciated that by the use of the individual live hinges which integrally attach the caps 66 to the connector housing, the conductors 58 may be independently removed or replaced without disassembling the connector. Since individual terminating caps are provided for the contacts, independent termination of the conductors to the contacts is possible, thus avoiding any problems of imcomplete terminations as might be encountered when utilizing a single tool for simultaneously connecting a plurality of conductors to contacts. Further, integral latching means is provided on the connector for releasably retaining the conductor terminating caps 66 in their closed position. Thus, it is seen that field servicing of the connector of the present invention is greatly simplified. While the connector has been illustrated and described herein as being a printed circuit board connector, it will be appreciated that the novel plural conductor terminating cap arrangement of the invention would be applicable to other forms of connectors, such as rack and panel connectors employing mating socket and pin contacts, for example.

What is claimed is:

1. An electrical connector for connecting a plurality of conductors each having a metallic core covered with insulation to conductive elements on a mating connection member comprising:

an elongated insulative housing;

said housing having a conductor receiving side and a mating side;

a row of spaced contact receiving cavities in said housing extending from said conductor receiving side to said mating side;

contacts mounted in said cavities, each said contact having a contacting section on said mating side and a termination section on said conductor receiving side;

said termination section of each said contact embodying insulation displacing, core penetrating jaws;

a row of individual conductor terminating caps on said conductor receiving side each aligned with a corresponding one of said contact termination sections;

a relatively thin hinge section pivotally connecting each of said caps to said housing, each said cap being movable from a first position overlying the end of its respective termination section to a second position out of a alignment with said termination section; and each said cap emboying means for forcibly inserting a conductor into the jaws of its corresponding contact to electrically connect said conductor to said contact when said cap is pivoted from said second position to said first position, each said conductor being individually removable from its contact when the corresponding cap thereof is pivoted from said first position to said second position.

2. An electrical connector as set forth in claim 1 including: latching means releasably securing said caps to said housing in said first position.

3. An electrical connector as set forth in claim 1 wherein:

said housing embodies an elongated printed circuit board receiving slot therein opening at said mating side, said cavities opening into said slot; and said contacting sections of said contacts extend into said slot for engaging conductive traces on a printed circuit board in said slot.

4. An electrical connector as set forth in claim 1 wherein:

said hinge sections are integral with said housing and said caps; and said housing and caps embody integral latching means for releasably securing said caps in said first position.

5. An electrical connector as set forth in claim 1 wherein:

said housing has first and second sidewalls;

said first wall extending outwardly further than said second wall and having an outer edge;

said hinge sections connecting said caps to said outer edge; and said caps, when in said first position, cooperate with said first wall to substantially enclose said termination sections of said contacts.

6. An electrical connector as set forth in claim 5 including:

latching means on said second wall and said caps for releasably securing said caps to said housing in said first position.

7. An electrical connector as set forth in claim 5 wherein: said hinge sections are integral with said caps and said first wall.

8. An electrical connector as set forth in claim 5 including:

an elongated resilient strip extending lengthwise of said housing, said strip being fixed at its opposite ends to said housing;

said strip having a downwardly facing surface adjacent to each of said caps; and each said cap having an upwardly facing shoulder engaging said surface to retain sad cap in said first position; and said strip being movable laterally away from said housing a distance sufficient to release said shoulder from said surface thereby allowing said cap to be pivoted to said second position.

9. An electrical connector as set forth in claim 5 wherein:

said first wall contains a plurality of slots therethrough each aligned with a corresponding one of said termination sections and being dimensioned to receive a conductor therethrough.

10. An electrical connector as set forth in claim 9 wherein:

each said cap has an inclined surface thereon extending from adjacent to said edge toward said second wall and facing said slot when said cap is in said second position, said inclined surface embodying said conductor insertion means.

11. An electrical connector as set forth in claim 10 wherein:

each said termination section has a generally tubular configuration, a pair of slots on opposite sides of said tubular termination section extending to the outer end thereof;

said slots in each termination section being aligned with a corresponding slot in said first wall;

the edges of said slot adjacent to said second wall defining said jaws; and the edges of said slot adjacent to said first wall providing insulation gripping, strain relief jaws.

* * * * *